United States Patent [19]

Divoux et al.

[11] 4,440,388

[45] Apr. 3, 1984

[54] APPARATUS FOR STACKING THIN FLEXIBLE OBJECTS

[75] Inventors: Michel Divoux; Michel Dorez, both of Paris, France

[73] Assignee: Hotchkiss-Brandt Sogeme H.B.S., Paris, France

[21] Appl. No.: 298,915

[22] Filed: Sep. 2, 1981

[30] Foreign Application Priority Data

Sep. 5, 1980 [FR] France ..... 80 19260

[51] Int. Cl.[3] ..... B65H 29/24

[52] U.S. Cl. ..... 271/195; 271/196; 271/186

[58] Field of Search ..... 271/195, 196, 194, 276, 271/177, 178, 184, 185, 186, 197, 188, 211; 414/106, 107, 108

[56] References Cited

U.S. PATENT DOCUMENTS

| | | | |
|---|---|---|---|
| 2,759,543 | 8/1956 | Conti | 271/194 X |
| 3,197,200 | 7/1965 | Byrt | 271/196 X |
| 3,330,556 | 7/1967 | Sarka | 271/195 X |
| 4,116,430 | 9/1978 | Winchester et al. | 271/196 X |
| 4,216,954 | 8/1980 | Kwasnitza | 271/196 X |

FOREIGN PATENT DOCUMENTS

| | | |
|---|---|---|
| 629435 | 5/1936 | Fed. Rep. of Germany . |
| 2644232 | 4/1977 | Fed. Rep. of Germany . |
| 1076715 | 10/1954 | France . |
| 2006566 | 12/1969 | France . |

*Primary Examiner*—Bruce H. Stoner, Jr.
*Assistant Examiner*—Lisa Rosenberg
*Attorney, Agent, or Firm*—Cushman, Darby & Cushman

[57] ABSTRACT

An apparatus for stacking thin objects which are delivered by a conveyor to a rotary drum having holes over its periphery extending to the interior and a fixed body within the interior having a plurality of chambers communicating with the holes over a half circumference. Valves connecting to the chambers are operated to successively connect the chamber to a vacuum source so the object is engaged and rotated with the drum and then to successively connect to a pressure source to produce a blowing action moving the object toward a stack.

5 Claims, 1 Drawing Figure

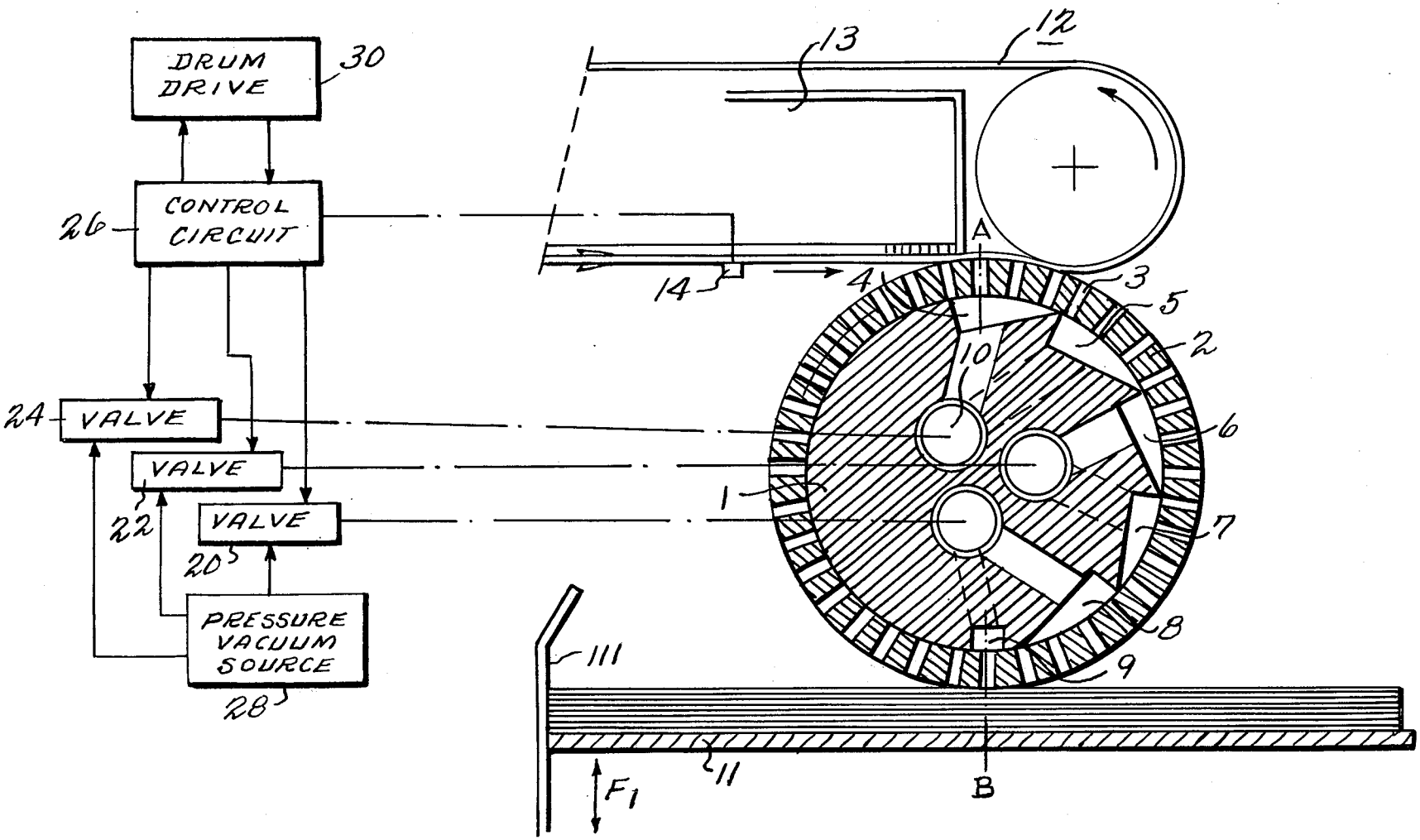
DRUM DRIVE
CONTROL CIRCUIT
VALVE
VALVE
VALVE
PRESSURE VACUUM SOURCE
30
26
24
22
20
28
12
13
14
A
B
1
2
3
4
5
6
7
8
9
10
11
111
$F_1$

APPARATUS FOR STACKING THIN FLEXIBLE OBJECTS

BACKGROUND OF THE INVENTION

The invention relates to an apparatus for stacking thin flexible objects, particularly sheets of paper in either the folded or unfolded state. Generally rudimentary means are used for stacking thin objects, e.g. in the form of a rack with a sloping bottom and using the action of gravity. Due to their natural velocity and once released by the handling system the objects abut against the front wall of the rack at the same time as they drop on to the stack being formed. However, there are serious limitations to the efficiency of such stacking procedures. Thus, the reliability of stacking is uncertain at the high supply speed and more particularly in the case of previously folded sheets. The sheets may stick together and they are not satisfactorily arranged on the stack.

BRIEF SUMMARY OF THE INVENTION

The object of the present invention is to obviate these disadvantages and relates to an apparatus ensuring stacking at high speed, with maximum reliability and a very satisfactory arranging of the objects in the stack formed. Moreover, when unstacking of the sheets takes place from the top of the stack, which is usually the case, the initial order in which the sheets were arranged is respected.

The invention more specifically relates to an apparatus for stacking thin flexible objects, wherein it comprises means able to ensure two functions: a first function of guiding and supporting objects coming from an upstream conveying system until the said objects arrive at the level of the plate of a downstream receptacle on which the stack is formed; and a second function of ejecting the objects when they are level with the stack in a correct axial position.

DESCRIPTION OF THE DRAWING AND PREFERRED EMBODIMENTS

The invention is described in greater detail hereinafter relative to non-limitative embodiments and the single drawing showing an apparatus according to the invention essentially comprising means ensuring the two functions, namely the guidance and supporting of the object above the stack being formed on the one hand and the downward ejection of these objects on arriving level with the stack in a correct axial position on the other hand. This makes it possible to obtain independence of possible defects or deficiencies of the objects (folds, turned-down corners), to correctly position them on the stack and to ensure a sufficiently rapid disengagement in the direction of the stack, thus preventing interactions between the objects at high speeds.

In an apparatus according to the invention the said supporting and ejection means are essentially constituted by an inner fixed body 1 and an outer rotary drum 2. The latter has holes 3 over its entire periphery. The fixed body 1 has a plurality of chambers open towards the rotary drum 2. In the present embodiment there are five chambers 4, 5, 6, 7 and 8 plus a further chamber 9. At the appropriate times the chambers according to the invention are placed under vacuum or pressure by associated electropneumatic valves 20, 22 and 24, to which they are connected by connecting (openings) manifolds such as 10. The sheets are stacked on plate 11 of a receptacle 111. The position of plate 11 is controlled in the manner indicated by arrow $F_1$ by means of a system for the detection of the upper level of the stack of sheets being formed and able to start up drive means which are not shown in the drawing. Plate 11 can be placed in a horizontal or an inclined position. The objects are brought level with the outer rotary drum 2 by a conveying system positioned upstream thereof. The conveying system may, as in the present embodiment, comprise a belt conveyor 12 cooperating with a vacuum chamber 13 for driving the objects engaging against said belt up to drum 2. Preferably the conveyor rotates at the same circumferential speed as the rotary drum. The arrival of an object on the latter occurring at a random time is detected by a passage sensor 14, which transmits a signal to the logic control 26 of the solenoid valves. The chambers are then placed under a vacuum at a given time. This leads to a suction effect which engages the object with the drum 2 and which takes place through hole 3. The object is then driven at the same time as the drum and is successively sucked level with chamber 4, chamber 5 and so on. Circuit 26 provides timing signals operating valves 20, 22 and 24 as a function of the conveying speed of drum drive 30 to link each chamber 4 to 9 of the fixed body 1 with a vacuum and pressure source 28 as the front of the object arrives at the right of each of them. The object which is in this way sucked against drum 2 is wound around the latter. When its front reaches the low point of the drum it is separated from the latter in order to follow its natural and substantially horizontal path. The back of the object remains in contact with the drum, the driving and lateral guidance thereof being maintained. It should be noted that the the rotary drum is positioned between the conveyor and the centre of the stack of sheets.

As soon as the front of the object reaches the front end of the stack, its rear which is still in contact with drum 2 is disengaged from the latter and is moved towards the stack of objects by a blowing action produced by the connection of the chambers of the fixed drum with a compressed air source 28 in accordance with a matched chronology. Thus, the apparatus according to the invention performs a suction and rotary blowing synchronous with the object advance movement. Chambers 4 to 9 are arranged along the complete path of the objects from the time that they are taken up by rotary drum 2 until they are released level with the receptacle where the stack is formed. Along the path (approximately a half-circumference of rotary drum 2) separating point A at which the object is taken up and point B corresponding to the start of its ejection they have a geometry ensuring a continuous suction or ejection zone, it being understood that the openings 3 in the drum can along the whole or part of this path be zonally connected in random manner alternatively with a vacuum source and a pressure source.

The invention is applicable to the stacking of any thin flexible object, such as in particular postal items, banknotes, etc.

What is claimed is:

1. Apparatus for stacking thin flexible objects comprising:

a rotary drum having holes over its periphery extending to the interior thereof;

a fixed body within said interior having a plurality of chambers communicating with said holes over a half circumference of said drum from one location on said body to a second location on said body;

valve means for connecting said chambers to a source of air at a pressure above atmospheric and to a vacuum;

conveying means for delivering said objects to said drum at said one location of said body;

means for controlling said valve means so that said objects are successively engaged with the drum by suction and rotate therewith as said chambers are successively connected to said vacuum and disengaged from said drum at said second location as said chambers are successively connected to said pressure source to produce a blowing action moving said object toward a stack of said objects.

2. Apparatus as in claim 1 wherein said drum is mounted for rotation between said conveying means and the stack of objects.

3. Apparatus as in claim 1 further including means connecting to said controlling means for detecting the arrival of an object on said conveying means.

4. Apparatus as in claim 1 further including a plate below said drum for receiving said stack.

5. Apparatus as in claim 1 including a plurality of manifolds each connecting at least one of said chambers to a valve means.

* * * * *